US010934719B2

(12) United States Patent
Steffes et al.

(10) Patent No.: US 10,934,719 B2
(45) Date of Patent: Mar. 2, 2021

(54) SIDING PANEL END PLUG AND METHOD OF INSTALLATION

(71) Applicant: CertainTeed LLC, Malvern, PA (US)

(72) Inventors: Stephen W. Steffes, McPherson, KS (US); Brian W. Kirn, Hatboro, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/351,257

(22) Filed: Mar. 12, 2019

(65) Prior Publication Data

US 2019/0284816 A1 Sep. 19, 2019

Related U.S. Application Data

(60) Provisional application No. 62/642,456, filed on Mar. 13, 2018.

(51) Int. Cl.
*E04F 13/08* (2006.01)

(52) U.S. Cl.
CPC ..... *E04F 13/0898* (2013.01); *E04F 13/0894* (2013.01)

(58) Field of Classification Search
CPC ..... E04F 13/0801; E04F 13/0803; E04F 13/0805; E04F 13/081; E04F 13/0828; E04F 13/0839; E04F 13/0864; E04F 13/0898; E04F 13/0894; E04F 13/0846; E04F 21/1855
See application file for complete search history.

(56) References Cited

U.S. PATENT DOCUMENTS 2,003,996 A * 6/1935 Finzer ..... E04F 13/0803 52/482
2,005,030 A * 6/1935 Geisinger ..... E04F 13/0803 52/384
3,171,232 A * 3/1965 Gretter ..... E04F 13/0844 52/714
3,321,883 A * 5/1967 Pascucci ..... E04F 13/0803 52/774
3,593,479 A 7/1971 Hinds
4,288,958 A * 9/1981 Chalmers ..... E04F 13/0864 52/478
5,522,193 A * 6/1996 Sommerstein ..... E04F 13/081 52/235

(Continued)

OTHER PUBLICATIONS

Stouffer Technologies, "Vinyl Siding Corner Inserts," available at https://stouffertech.com/vinyl-siding-corner-inserts/, downloaded Nov. 9, 2017.

*Primary Examiner* — Kyle J. Walraed-Sullivan
(74) *Attorney, Agent, or Firm* — McDonnell Boehnen Hulbert & Berghoff LLP

(57) ABSTRACT

One aspect of the disclosure is a siding panel end plug including a body having a front face, a rear face, a side face connecting the front face and rear face, a top edge, a bottom edge, and a hollow space located between the front face, rear face, and side face. The siding panel end plug further includes a first locking mechanism disposed on the top edge and a second locking mechanism disposed on the bottom edge. The first locking mechanism and the second locking mechanism facilitate both locking and unlocking of the siding panel end plug from a second siding panel end plug and a third siding panel end plug.

18 Claims, 6 Drawing Sheets

(56) References Cited

U.S. PATENT DOCUMENTS

| | | | | |
|---|---|---|---|---|
| 5,829,206 | A | 11/1998 | Bachman | |
| 5,974,748 | A | 11/1999 | Sciuga | |
| 6,044,609 | A * | 4/2000 | Kim | E04F 13/0864 52/551 |
| 6,421,975 | B2 | 7/2002 | Bryant | |
| 6,782,666 | B1 | 8/2004 | Condon | |
| 6,976,342 | B1 | 12/2005 | Kowalevich | |
| 8,146,307 | B1 * | 4/2012 | Loper | E04F 19/024 52/211 |
| 8,381,472 | B1 * | 2/2013 | Fleenor | E04F 13/0825 52/459 |
| 9,297,166 | B2 * | 3/2016 | Carbines | E04F 13/0803 |
| 2009/0178290 | A1 * | 7/2009 | Larsson | E04F 21/1855 33/647 |
| 2012/0199708 | A1 * | 8/2012 | Convey | A47F 5/0846 248/201 |
| 2012/0292474 | A1 * | 11/2012 | Desch nes | E04F 13/0803 248/309.1 |
| 2017/0044774 | A1 * | 2/2017 | Anic | E04F 13/0814 |

* cited by examiner

SIDING PANEL END PLUG AND METHOD OF INSTALLATION

CROSS-REFERENCE TO RELATED APPLICATIONS

This application claims the benefit of priority of U.S. Provisional Patent Application No. 62/642,456, filed Mar. 13, 2018, which is hereby incorporated herein by reference in its entirety.

BACKGROUND OF THE DISCLOSURE

1. Field of the Disclosure

The present disclosure relates generally to siding and siding accessories. The present disclosure relates more particularly to siding end pugs.

2. Technical Background

Siding products can simulate traditional materials such as wooden clapboards, cedar shakes and the like. Traditional wood siding materials are generally installed in overlapped single tiers or courses. Each wood clapboard course typically includes a row of horizontally or vertically elongated planks (clapboards), butted end to end. Except at the extreme top and bottom, each row is overlapped at its top edge by a next higher course, and in turn laps over a next lower course, to the edges of the sided area.

In multiple siding styles, clearance is needed to accommodate thermal expansion and contraction. Siding materials such as vinyl and other polymers and resins often have a high coefficient of thermal expansion, and regularly cycle through a range of temperature conditions due to exterior installations and exposure to the elements. Thermal expansion is accommodated by providing clearance that permits the siding to expand at higher temperatures and to contract at lower temperatures.

Clearance is also needed so that the ends of panels that extend up to obstructions, or terminate at outside corners or the like, can be fitted under covering molding strips during installation. Siding accessories such as J-moldings, for example, are used to frame windows, doors, roof lines, etc., where the moldings form channels to receive and cover the extreme ends of the panels. The panels need clearance, along the direction of elongation of the course, so that the installer can fit each endmost panel into its course and then slide the panel endwise into the channel of the J-molding or similar trim. The channel or trim should be deep enough to cover the end of the adjacent panel when the panel and the course as a whole have retracted in cold weather. The fit of the panels, fasteners, and any joints along the course should be loose enough so the panels can slide as needed.

The clearance can create large gaps which may cause the siding to appear unfinished or substandard. Accordingly, there is a need for an improved siding accessory that provides a more aesthetically appealing overall look while still maintaining the required clearance for the siding panels.

SUMMARY OF THE DISCLOSURE

One aspect of the disclosure is a siding panel end plug comprising:

- a body having a front face, a rear face, a side face connecting the front face and rear face, a top edge, a bottom edge, and a hollow space located between the front face, rear face, and side face;
- a first locking mechanism disposed on the top edge; and
- a second locking mechanism disposed on the bottom edge;
- wherein the first locking mechanism is configured to interlock with a second locking mechanism on a second siding panel end plug, and the second locking mechanism is configured to interlock with a first locking mechanism on a third siding panel end plug.

In certain embodiments, the first locking mechanism comprises two grooves and the second locking mechanism comprises two projections.

In certain embodiments, the siding panel end plug is injection molded.

Another aspect of the disclosure is a siding panel apparatus comprising:

- a siding panel having a front face, a rear face, a top edge, a bottom edge, a first side, and a second side;
- a piece of trim connected to the first side of the siding panel, wherein a gap is formed between a portion of the piece of trim and the first side of the siding panel;
- at least one end plug located within the gap between the siding panel and the piece of trim, comprising a body having a front face, a rear face, a side face connecting the front face and rear face, a top edge, a bottom edge, and a hollow space located between the front face, rear face, and side face;
- a first locking mechanism disposed on the top edge of the end plug; and
- a second locking mechanism disposed on the bottom edge of the end plug;
- wherein the first locking mechanism is configured to interlock with a second locking mechanism on a second siding panel end plug, and the second locking mechanism is configured to interlock with a first locking mechanism on a third siding panel end plug.

Another aspect of the disclosure is a method for installing a plurality of siding end plugs as described herein. The method includes:

- providing a plurality of end plugs, each end plug comprising a body having a front face, a rear face, a side face connecting the front face and rear face, a top edge, a bottom edge, and a hollow space located between the front face, rear face, and side face;
- locking the bottom edge of a first end plug to the top edge of a second end plug; and
- locking the front and rear faces of the first end plug to the hollow space of a third end plug, and locking the front and rear faces of the second end plug to the hollow space of a fourth end plug.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

The present inventors have noted disadvantages of conventional methods of installing siding panels and accessories. In one example, the required clearance between the siding panels and accessories may cause an unfinished look to the siding. The present inventors have noted that the use of an end plug may create a more aesthetically pleasing look to the finished siding while still allowing for the appropriate clearance to accommodate for expansion and contraction due to external temperature conditions.

Accordingly, one aspect of the disclosure is a siding panel end plug having a body, a first locking mechanism, and a second locking mechanism. The first locking mechanism is configured to interlock with a second locking mechanism on a second siding panel end plug, and the second locking mechanism is configured to interlock with a first locking mechanism on a third siding panel end plug. Additionally, the siding panel end plug can be manufactured by injection molding. The structure of the end plug as well as the material of which it is constructed allow for appropriate expansion and contraction of the siding panel when the end plug is installed between the siding panel and a piece of trim.

Figure 2:
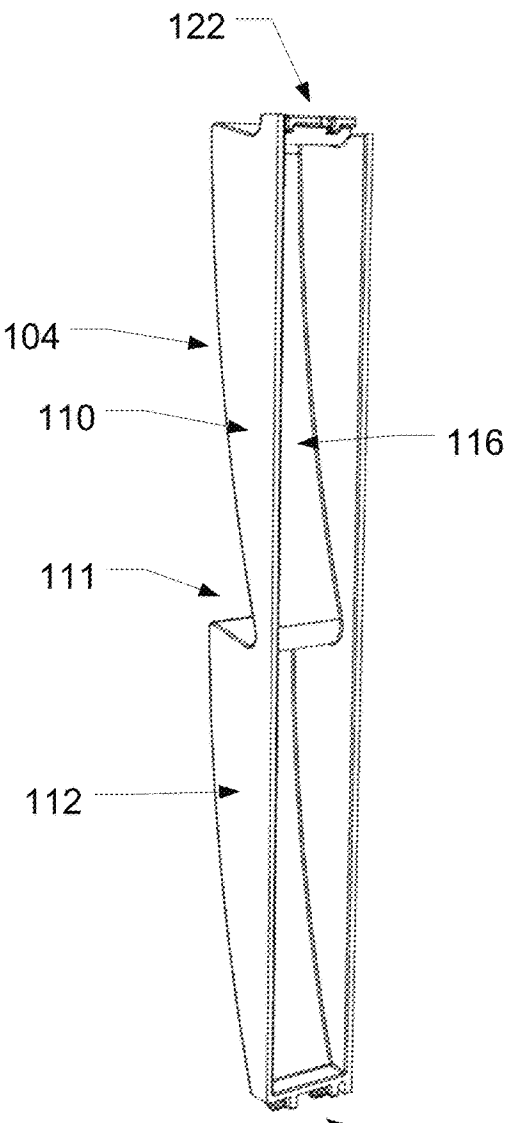
FIG. 2 is a schematic opposite perspective view of the end plug of FIG. 1.
Figure 1:
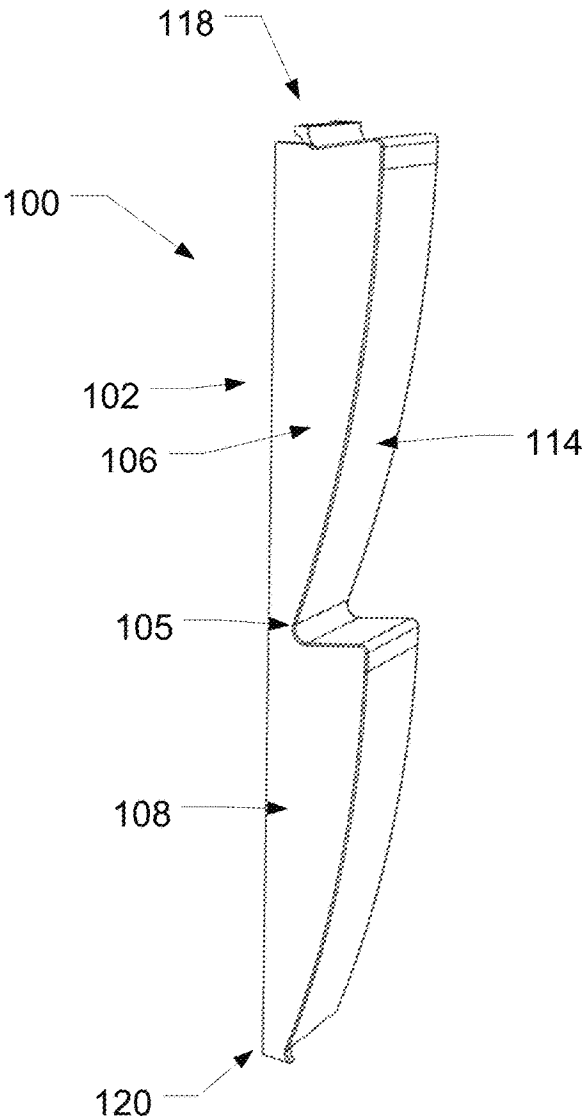
FIG. 1 is a schematic perspective view of an end plug according to one embodiment of the disclosure.
Figure 3:
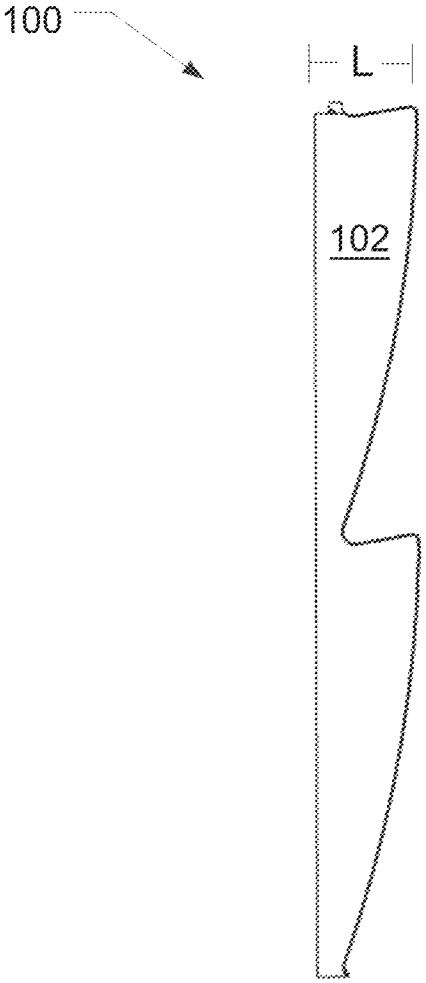
FIG. 3 is a schematic side view of the end plug shown in FIG. 1.

One embodiment of such a siding panel end plug is described with respect to FIGS. 1-1-8 below. FIGS. 1-6 show an example siding panel end plug 100 according to an embodiment of the disclosure. The end plug 100 may comprise a front face 102 and a rear face 104 opposite the front face. The front face 102 may include two outwardly extending sections 106, 108 separated by a groove 105. As shown in FIGS. 1-3, the outwardly extending sections 106, 108 may have a rounded or curved profile. It should be understood in certain embodiments as otherwise disclosed herein the outwardly extending sections may have differently shaped profiles.

The rear face 104 of the end plug 100 may also include two outwardly extending sections 110, 112 separated by a groove 111. In some embodiments, the rear face 104 may be substantially identical to the front face 102. In certain embodiments as otherwise disclosed herein, the rear face 104 may have a different structure than the front face 102. Again, as shown in FIGS. 1-3, the outwardly extending sections 110, 112 may have a rounded or curved profile, but it should be understood in certain embodiments as otherwise disclosed herein the outwardly extending sections may have differently shaped profiles.

Figure 4:
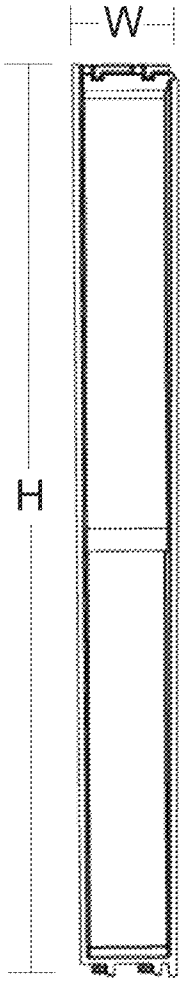
FIG. 4 is a schematic rear view of the end plug shown in FIG. 1.
Figure 10:
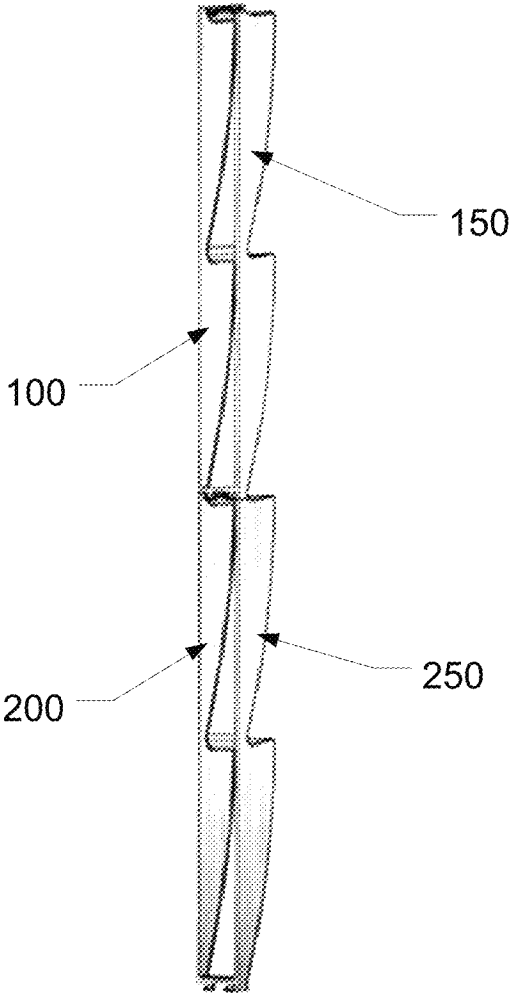
FIG. 10 is a schematic perspective view of a plurality of end plugs interlocking according to an embodiment of the disclosure.
Figure 9:
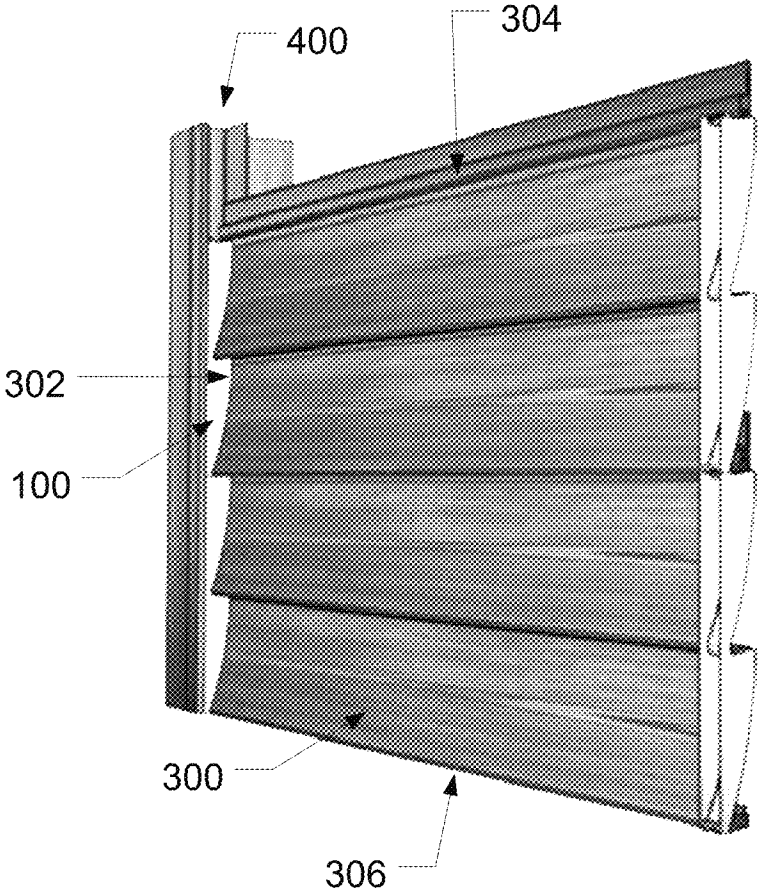
FIG. 9 is a schematic perspective view of a plurality of end plugs installed in siding panels.

The front and rear faces 102, 104 are connected by a side face 114, which follows the shape of the outwardly extending sections 106, 108, 110, 112 and grooves 105, 111 of the front and rear faces 102, 104. A hollow space 116 is present between the front and rear faces 102, 104 and the side face 114 is open on the other side, as shown in FIGS. 2 and 4, which allows for the end plug 100 to interlock side by side with another end plug, as shown in FIGS. 9 and 10, and which is described in more detail below. The hollow space 116 extends along the entire length of the end plug 100. It should be understood that in some embodiments, the hollow space 116 may be formed as two separate hollow spaces, one in the upper region between outwardly extending sections 106 and 110, and another in the lower region between outwardly extending sections 108 and 112. Other configurations are possible as well.

The end plug 100 also includes a first end 118, and a second end 120, the first end being opposite the second end. In some embodiments, the first end 118 may be placed at or near a top edge of a siding panel and the second end may be placed at or near a bottom edge of a siding panel.

In certain embodiments as otherwise disclosed herein, the end plug 100 may be formed with specific dimensions as described herein with reference to FIGS. 3 and 4. For example, in some embodiments, the overall height H of the end plug 100 may be in the range of about 6 in. to about 12 in. In some embodiments, the width W of the end plug, or the distance between the front face 102 and the rear face 104, may be in the range of about 0.5 in. to about 1 in, for instance. In some embodiments, the length L of the top edge 118 may be in the range of about 0.5 in. to about 1 in.

Referring again to FIG. 2, the end plug 100 also includes a first locking mechanism 122 located at or near the first end 118. The first locking mechanism 122 is configured to interlock with a second locking mechanism of a second adjacent end plug, as described below. The interlocking connection facilitates the locking of the end plug during installation. The interlocking feature may also prevent gaps or misalignments between end plugs.

Figure 5:
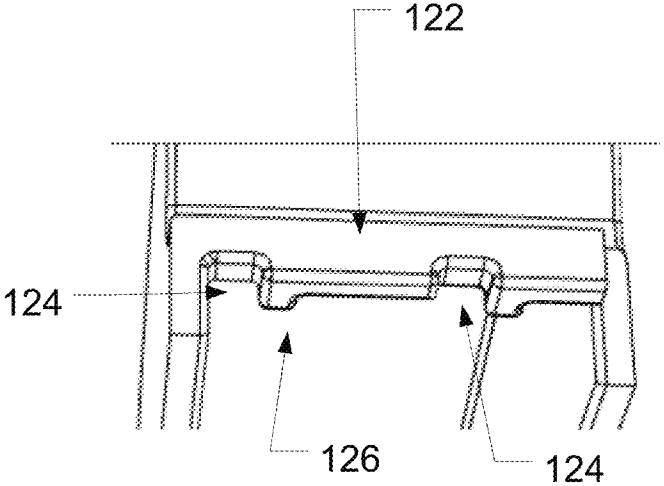
FIG. 5 is a schematic top perspective view of a first locking mechanism of the end plug shown in FIG. 1.

As shown in FIG. 5, the first locking mechanism 122 may comprise two grooves 124, which may be generally U-shaped. In some embodiments, more or less grooves may be present. The grooves 124 interlock with corresponding projections on a second end plug to secure the two end plugs together. The U-shaped grooves 124 each have a protuberance 126 located on one side. The protuberance 126 acts as a stop to secure the corresponding projections in place.

Figure 6:
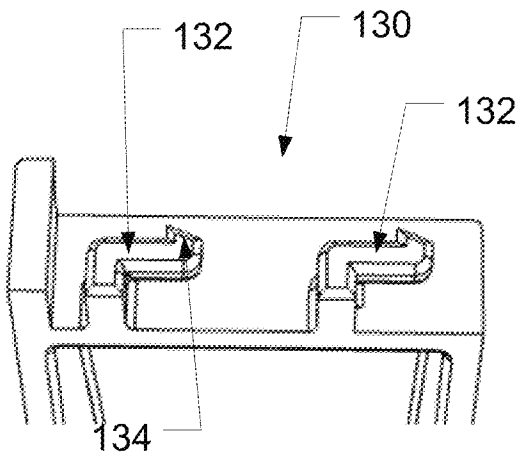
FIG. 6 is a schematic side view of a second locking mechanism of the end plug shown in FIG. 1.

Referring again to FIG. 2, the end plug 100 further includes a second locking mechanism 130 located at or near the second end 120, which is configured to interlock with a first locking mechanism of another adjacent, or third, end plug, as described below. The second locking mechanism 130 comprises two projections 132, which may be in the form of generally L-shaped hooks, as best seen in FIG. 6. In some embodiments, more or less projections may be present. As mentioned above, the projections 132 interlock with corresponding grooves on another end plug to secure the two end plugs together. The projections 132 each include a barb 134, which interact with the protuberance 126 of the first locking mechanism 122 to secure the end plug in place.

Although the first locking mechanism 122 is shown as a groove and the second locking mechanism 130 is shown as a projection, it should be understood that in alternate embodiments the first locking mechanism may comprise one or more projections and the second locking mechanism may comprise one or more corresponding grooves. Additionally, it should be understood that in certain embodiments as otherwise disclosed herein the first and second locking mechanisms may comprise any suitable locking mechanisms, such as an adhesive, tape, hoop and loop, snap-fit, or barbed features, mechanical fasteners, or molded-in fasteners such as snap-joints, for example.

Figure 7:
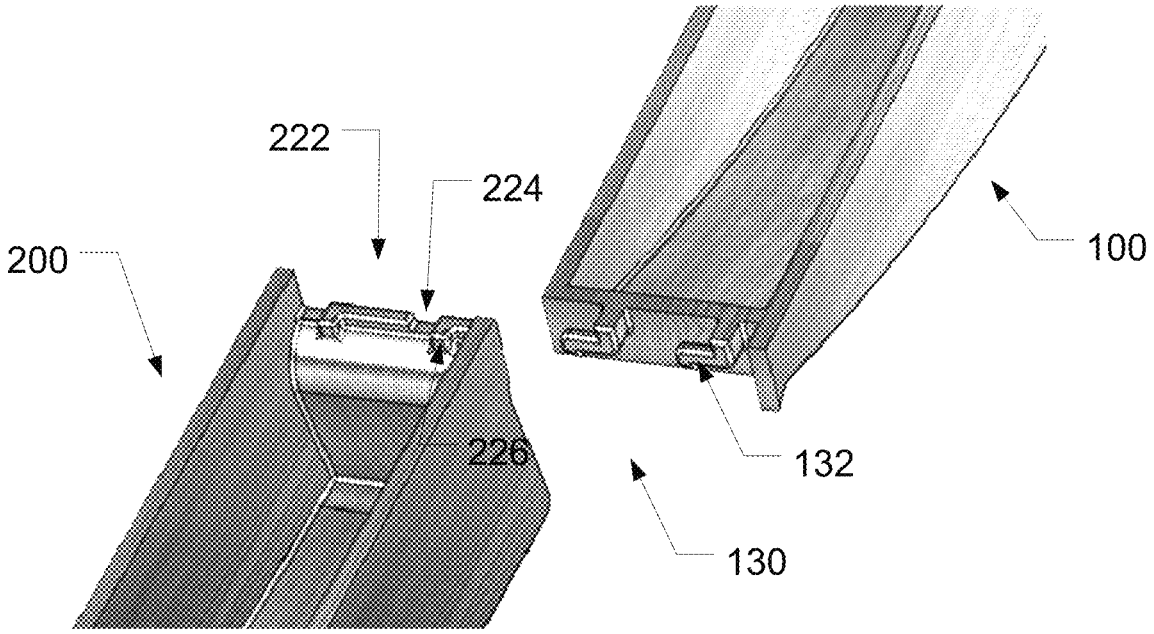
FIG. 7 is a schematic perspective view of first and second locking mechanisms.
Figure 8:
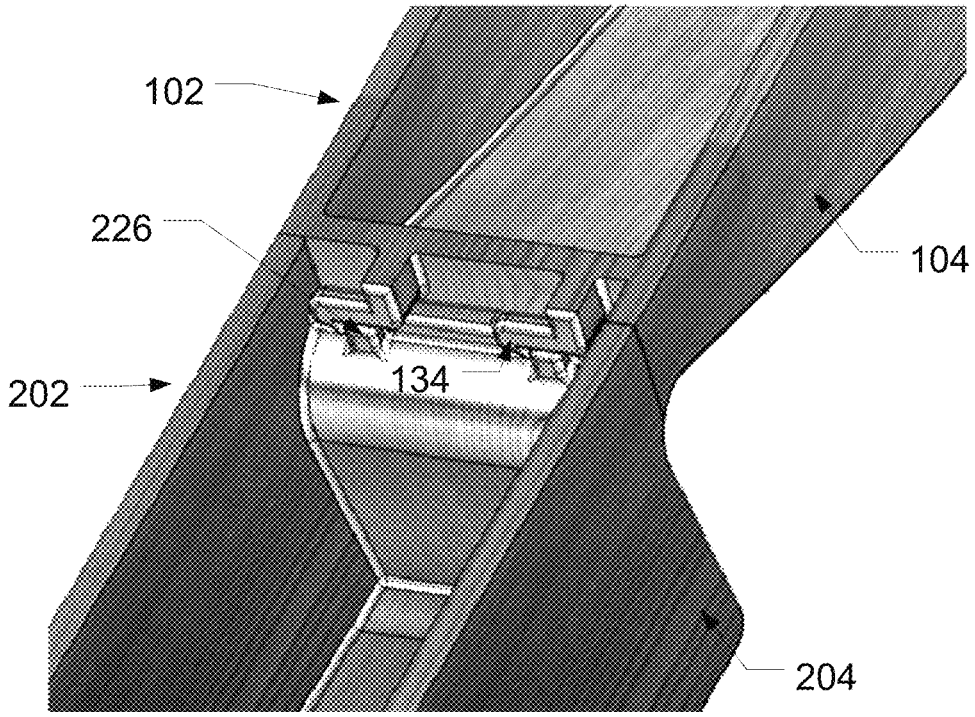
FIG. 8 is a schematic perspective view of two locking mechanisms interlocked together.

In use, a first end plug 100 can be connected to a second end plug 200, as shown in FIGS. 7-8. Like parts are designated by like reference numbers (i.e., first locking mechanism 122 of first end plug 100 is similar to first locking mechanism 222 of second end plug 200). The L-shaped hooks 132 of the second locking mechanism 130 on the first end plug 100 are inserted into the grooves 224 of the first locking mechanism 220 of the second end plug 200. When fully interlocked, the protuberances 226 abut the barbs 134 to securely connect the first end plug 100 to the second end plug 200. Additionally, when interlocked, the front faces 102, 202, and the rear faces 104, 204 of the end plugs align, as shown in FIG. 8.

As shown in FIGS. 9-10, a siding panel 300 is mounted onto a surface (not shown). In most instances, the surface is a vertical surface such as a wall of a building. The siding panel 300 is placed adjacent a siding accessory, such as a piece of trim 400. In certain embodiments as otherwise disclosed herein, the trim may be a J-channel or corner post, for example. As mentioned above, a gap or clearance is needed between the siding panel and the trim during installation in order to accommodate expansion and contraction of the panel during a range of external temperature conditions. In certain instances, a user may wish to fill in the gap while still allowing for sufficient clearance. Thus, as shown in FIG. 9, one or more end plugs 100 may be inserted between the first edge 302 of the siding panel 300 and the piece of trim 400 to fill the gap between the two pieces and allow for a more aesthetically appealing look, while still allowing for sufficient clearance for expansion and contraction of the siding panel. The end plugs may be interlocked end to end to extend from a top edge 304 of the siding panel to a bottom edge 306 of the siding panel 300.

FIG. 10 shows a view of the interlocking of four end plugs. When two end plugs 100, 200 are brought together end to end, the first locking mechanism of one end plug interlocks with the second locking mechanism of another end plug which secures them together, as described above with respect to FIGS. 7-8. Additionally, when two end plugs 100, 150 are brought together side by side, the two outwardly extending projections 106, 108 of the front face 102 and the two outwardly extending projections 110, 112 of the rear face 104 interlock with the hollow space 116 of another siding panel end plug to connect the end plugs together. As many end plugs may be connected together as is desired to fill the gap between the siding panel 300 and the trim 400.

Figure 12:
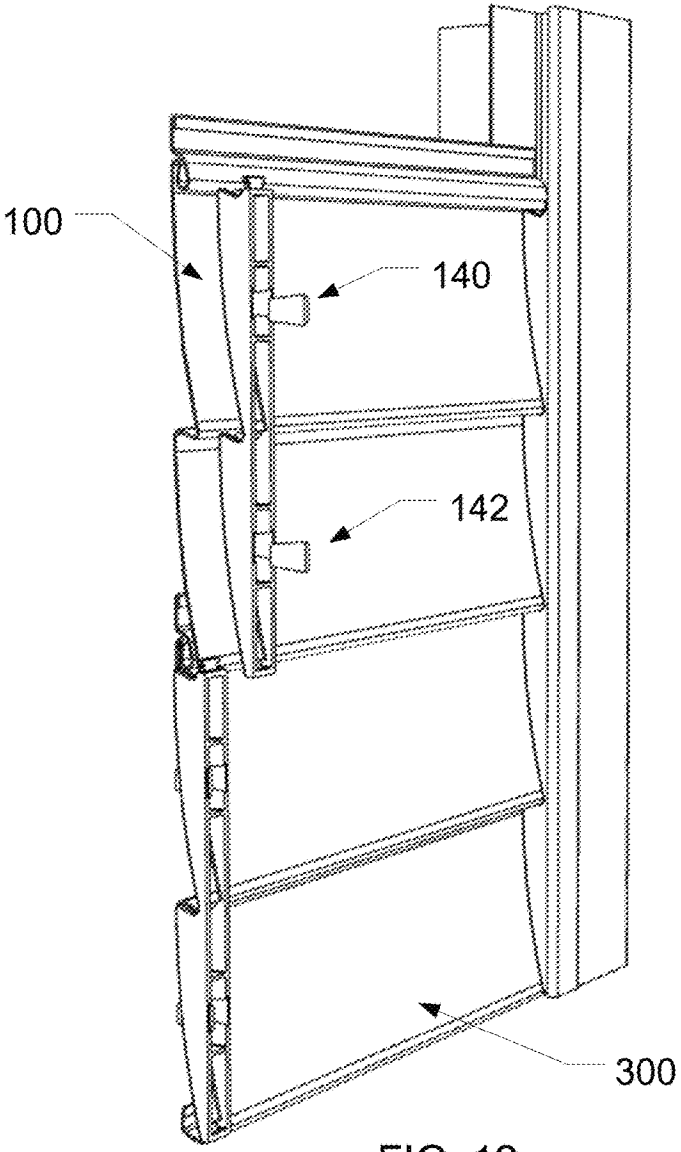
FIG. 12 is a schematic perspective view of a plurality of the end plugs with accessories shown in FIG. 11 installed in siding panels.
Figure 11:
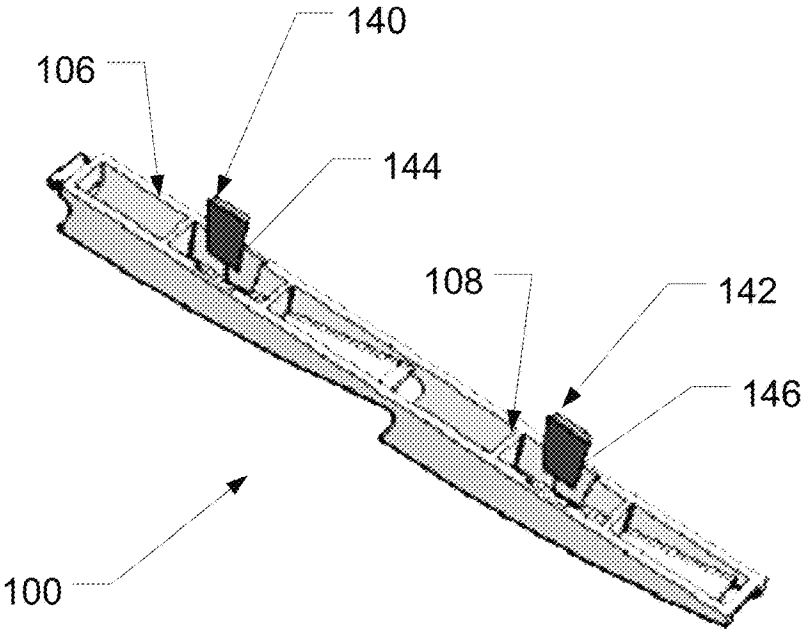
FIG. 11 is a schematic perspective view of an end plug including an accessory.

FIGS. 11-12 show an example accessory for use with the end plug 100. The accessory may be in the form of a stop 140, which is used to hold the end plug 100 in place when installed on a siding panel 300. As shown in FIG. 11, two stops 140, 142 may be positioned on the end plug 100. In one embodiment, a first stop 140 is placed on the outwardly extending section 106 and a second stop 142 is placed on the outwardly extending section 108. The end plug 100 may include first and second indentations 144, 146 for receiving the first and stops 140, 142, respectively. The stops 140, 142 hold the end plug 100 in place on a siding panel so the end plug does not move or fall out.

Notably, the end plugs of the present disclosure are injection molded, which provides a cost savings during production, as well as a light weight product. The injection molding process also allows for a higher speed and higher volume close tolerance production.

The siding panel end plugs and stops of the present disclosure may be constructed of any known siding material, such as PVC, polymer, polypropylene, acrylic, Acrylonitrile Styrene Acrylate (ASA), fiberglass, aluminum, steel, any other plastic, wood, or metal, or combinations thereof.

As the person of ordinary skill in the art will appreciate, the siding panels disclosed herein may be constructed of a single piece or layer of material, such as vinyl, allowing for inexpensive production. In certain embodiments as otherwise disclosed herein, the material may comprise any known siding material, such as PVC, polymer, polypropylene, acrylic, Acrylonitrile Styrene Acrylate (ASA), fiberglass, aluminum, steel, any other plastic, wood, or metal, or combinations thereof. The siding panels of the present disclosure may be manufactured by any known method.

The following listing of numbered embodiments form additional aspects of the disclosure. They may be combined and permuted in any fashion and in any number that is not logically or technically inconsistent.

Embodiment 1

A siding panel end plug comprising:

a body having a front face, a rear face, a side face connecting the front face and rear face, a top edge, a bottom edge, and a hollow space located between the front face, rear face, and side face;

a first locking mechanism disposed on the top edge; and a second locking mechanism disposed on the bottom edge;

wherein the first locking mechanism is configured to interlock with a second locking mechanism on a second siding panel end plug, and the second locking mechanism is configured to interlock with a first locking mechanism on a third siding panel end plug.

Embodiment 2

The siding panel end plug of embodiment 1 wherein the front face includes at least one outwardly extending projection and the rear face includes at least one outwardly extending projection.

Embodiment 3

The siding panel end plug of embodiment 1 or 2 wherein the front face includes two outwardly extending projections separated by a first groove and the rear face includes two outwardly extending projections separated by a second groove.

Embodiment 4

The siding panel end plug of embodiment 3 wherein the two outwardly extending projections of the front face and the two outwardly extending projections of the rear face are configured to interlock with the hollow space of another siding panel end plug to connect the end plugs together.

Embodiment 5

The siding panel end plug of any of embodiments 1-4, wherein the front face and the rear face each have a curved profile.

Embodiment 6

The siding panel end plug of any of embodiments 1-5, wherein the first locking mechanism comprises at least one of a projection, a hook, a barb, a groove, adhesive, a loop, or any type of mechanical or molded fastener.

Embodiment 7

The siding panel end plug of any of embodiments 1-6, wherein the second locking mechanism comprises at least one of a projection, a hook, a barb, a groove, adhesive, a loop, or any type of mechanical or molded fastener.

Embodiment 8

The siding panel end plug of any of embodiments 1-7, wherein the first locking mechanism comprises two grooves and the second locking mechanism comprises two projections.

Embodiment 9

The siding panel end plug of embodiment 8, wherein the two grooves are generally U-shaped and each have a protuberance located on one side.

Embodiment 10

The siding panel end plug of embodiment 9, wherein the two projections are generally L-shaped hooks and each include a barb configured to interact with the protuberances of the two grooves.

Embodiment 11

The siding panel end plug of any of embodiments 1-10, wherein a height of end plug is in the range of about 6 in. to about 12 in.

Embodiment 12

The siding panel end plug of any of embodiments 1-11, wherein a distance between the front face and the rear face of the end plug is in the range of about 0.5 in. to about 1 in.

Embodiment 13

The siding panel end plug of any of embodiments 1-12, wherein a length of the top edge of the end plug is in the range of about 0.5 in. to about 1 in.

Embodiment 14

The siding panel end plug of any of embodiments 1-13, wherein the siding panel end plug is injection molded.

Embodiment 15

The siding panel end plug of any of embodiments 1-14, wherein the siding panel end plug is constructed from PVC, polymer, polypropylene, acrylic, Acrylonitrile Styrene Acrylate (ASA), fiberglass, aluminum, steel, any other plastic, wood, or metal, or combinations thereof.

Embodiment 16

A method for manufacturing the siding panel end plug of any of embodiments 1-15.

Embodiment 17

A siding panel apparatus comprising:

a siding panel having a front face, a rear face, a top edge, a bottom edge, a first side, and a second side;

a piece of trim connected to the first side of the siding panel, wherein a gap is formed between a portion of the piece of trim and the first side of the siding panel;

at least one end plug located within the gap between the siding panel and the piece of trim, comprising a body having a front face, a rear face, a side face connecting the front face and rear face, a top edge, a bottom edge, and a hollow space located between the front face, rear face, and side face;

a first locking mechanism disposed on the top edge of the end plug; and a second locking mechanism disposed on the bottom edge of the end plug;

wherein the first locking mechanism is configured to interlock with a second locking mechanism on a second siding panel end plug, and the second locking mechanism is configured to interlock with a first locking mechanism on a third siding panel end plug.

Embodiment 18

The siding panel apparatus of embodiment 17, wherein the end plug extends from the top edge of the siding panel to the bottom edge of the siding panel.

Embodiment 19

The siding panel apparatus of embodiment 17 or 18, wherein the at least one end plug comprises a plurality of end plugs connected together to fill the gap between the siding panel and the piece of trim.

Embodiment 20

The siding panel apparatus of any of embodiments 17-19, wherein the front face of the end plug includes two outwardly extending projections separated by a first groove and the rear face includes two outwardly extending projections separated by a second groove, and wherein the two outwardly extending projections of the front face and the two outwardly extending projections of the rear face are configured to interlock with the hollow space of another siding panel end plug to connect the end plugs together.

Embodiment 21

The siding panel apparatus of any of embodiments 17-20, wherein the first locking mechanism comprises at least one of a projection, a hook, a barb, a groove, adhesive, a loop, or any type of mechanical or molded fastener.

Embodiment 22

The siding panel apparatus of any of embodiments 17-21, wherein the second locking mechanism comprises at least one of a projection, a hook, a barb, a groove, adhesive, a loop, or any type of mechanical or molded fastener.

Embodiment 23

The siding panel apparatus of any of embodiments 17-22 wherein the first locking mechanism comprises two grooves and the second locking mechanism comprises two projections.

Embodiment 24

The siding panel apparatus of any of embodiments 17-23, wherein the end plug is injection molded.

Embodiment 25

The siding panel apparatus of any of embodiments 17-24, wherein the piece of trim comprises a J-channel or corner post.

Embodiment 26

The siding panel apparatus of any of embodiments 17-25, wherein the siding panel end plug is constructed from PVC, polymer, polypropylene, acrylic, Acrylonitrile Styrene Acrylate (ASA), fiberglass, aluminum, steel, any other plastic, wood, or metal, or combinations thereof.

Embodiment 27

A method for manufacturing the siding panel apparatus of any of embodiments 17-26.

Embodiment 28

A method for installing a plurality of siding panel end plugs, the method comprising:

providing a plurality of end plugs, each end plug comprising a body having a front face, a rear face, a side face connecting the front face and rear face, a top edge, a bottom edge, and a hollow space located between the front face, rear face, and side face;

locking the bottom edge of a first end plug to the top edge of a second end plug; and locking the front and rear faces of the first end plug to the hollow space of a third end plug, and locking the front and rear faces of the second end plug to the hollow space of a fourth end plug.

Embodiment 29

The method of embodiment 28 wherein the siding panel end plug is injection molded.

Embodiment 30

The method of embodiment 28 or 29, wherein the siding panel end plug is constructed from PVC, polymer, polypropylene, acrylic, Acrylonitrile Styrene Acrylate (ASA), fiberglass, aluminum, steel, any other plastic, wood, or metal, or combinations thereof.

Embodiment 31

The method of embodiment 28, further comprising positioning at least one stop onto the front face of the end plug to hold the end plug in place on the siding panel.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A siding panel end plug comprising:

a body having a front face, a rear face, a side face connecting the front face and rear face, a top edge, a bottom edge, and a hollow space located between the front face, rear face, and side face;

a first locking mechanism disposed on the top edge; and a second locking mechanism disposed on the bottom edge;

wherein the first locking mechanism is configured to interlock with a second locking mechanism on a second siding panel end plug, and the second locking mechanism is configured to interlock with a first locking mechanism on a third siding panel end plug, wherein the first locking mechanism comprises one of a groove and a projection, and the second locking mechanism comprises the other of a groove and a projection, wherein the groove is generally U-shaped and has a protuberance located on one side, and wherein the protuberance is offset from the side face.

2. The siding panel end plug of claim 1 wherein the front face includes at least one outwardly extending projection and the rear face includes at least one outwardly extending projection.

3. The siding panel end plug of claim 1 wherein the front face includes two outwardly extending projections separated by a first groove and the rear face includes two outwardly extending projections separated by a second groove.

4. The siding panel end plug of claim 3 wherein the two outwardly extending projections of the front face and the two outwardly extending projections of the rear face are configured to interlock with the hollow space of another siding panel end plug to connect the siding panel end plug and the other siding panel end plug together.

5. The siding panel end plug of claim 1, wherein the front face and the rear face each have a curved profile.

6. The siding panel end plug of claim 1, wherein the first locking mechanism comprises two grooves and the second locking mechanism comprises two projections.

7. The siding panel end plug of claim 1, wherein the siding panel end plug is injection molded.

8. The siding panel end plug of claim 1, wherein the siding panel end plug is constructed from PVC, polymer, polypropylene, acrylic, Acrylonitrile Styrene Acrylate (ASA), fiberglass, aluminum, steel, any other plastic, wood, or metal, or combinations thereof.

9. A siding panel end plug comprising:

a body having a front face, a rear face, a side face connecting the front face and rear face, a top edge, a bottom edge, and a hollow space located between the front face, rear face, and side face;

a first locking mechanism disposed on the top edge; and a second locking mechanism disposed on the bottom edge;

wherein the first locking mechanism is configured to interlock with a second locking mechanism on a second siding panel end plug, and the second locking mechanism is configured to interlock with a first locking mechanism on a third siding panel end plug, wherein the first locking mechanism comprises two grooves and the second locking mechanism comprises two projections, and wherein the two grooves are generally U-shaped and each have a protuberance located on one side.

10. The siding panel end plug of claim 9, wherein the two projections are generally L-shaped hooks and each include a barb configured to interact with the protuberances of the two grooves.

11. The siding panel end plug of claim 9 wherein the front face includes at least one outwardly extending projection and the rear face includes at least one outwardly extending projection.

12. The siding panel end plug of claim 9 wherein the front face includes two outwardly extending projections separated by a first groove and the rear face includes two outwardly extending projections separated by a second groove.

13. The siding panel end plug of claim 12 wherein the two outwardly extending projections of the front face and the two outwardly extending projections of the rear face are configured to interlock with the hollow space of another siding panel end plug to connect the siding panel end plug and the other siding panel end plug together.

14. A siding panel apparatus comprising:

a siding panel having a front face, a rear face, a top edge, a bottom edge, a first side, and a second side;

a piece of trim connected to the first side of the siding panel, wherein a gap is formed between a portion of the piece of trim and the first side of the siding panel;

a first end plug located within the gap between the siding panel and the piece of trim; and a second end plug, wherein each of the first end plug and second end plug comprises:

a body having a front face, a rear face, a side face connecting the front face and rear face, a top edge, a bottom edge, and a hollow space located between the front face, rear face, and side face;

a first locking mechanism disposed on the top edge of the body; and a second locking mechanism disposed on the bottom edge of the body, wherein the first locking mechanism comprises two grooves and the second locking mechanism comprises two projections, and wherein the two grooves are generally U-shaped and each have a protuberance located on one side; and wherein the first locking mechanism of the first end plug is secured to the second locking mechanism of the second end plug.

15. The siding panel apparatus of claim 14, wherein the first end plug extends from the top edge of the siding panel to the bottom edge of the siding panel.

16. The siding panel apparatus of claim 14, wherein the first end plug and second end plug are two of a plurality of end plugs connected together to fill the gap between the siding panel and the piece of trim.

17. The siding panel apparatus of claim 14, wherein the front face of the first end plug includes two outwardly extending projections separated by a first groove and the rear face includes two outwardly extending projections separated by a second groove, and wherein the two outwardly extending projections of the front face and the two outwardly extending projections of the rear face are configured to interlock with the hollow space of another siding panel end plug to connect the first end plug and the other end plug together.

18. The siding panel apparatus of any of claim 14 wherein the first locking mechanism of the first end plug comprises two grooves and the second locking mechanism of the first end plug comprises two projections.

* * * * *